US007672469B2

(12) United States Patent
Dyer et al.

(10) Patent No.: US 7,672,469 B2
(45) **Date of Patent: *Mar. 2, 2010**

(54) IN-EAR MONITORS WITH REMOVABLE CABLES

(75) Inventors: Medford Alan Dyer, San Diego, CA (US); Jerry J. Harvey, Newport Beach, CA (US); Robert G. Allison, San Juan Capistrano, CA (US)

(73) Assignee: Logitech International, S.A. (CH)

( * ) Notice: Subject to any disclaimer, the term of this patent is extended or adjusted under 35 U.S.C. 154(b) by 1140 days.

This patent is subject to a terminal disclaimer.

(21) Appl. No.: 11/281,097

(22) Filed: Nov. 17, 2005

(65) Prior Publication Data

US 2006/0133632 A1 Jun. 22, 2006

Related U.S. Application Data

(63) Continuation-in-part of application No. 11/044,510, filed on Jan. 27, 2005, now Pat. No. 7,194,102, which is a continuation-in-part of application No. 11/034,144, filed on Jan. 12, 2005, now Pat. No. 7,194,103, and a continuation-in-part of application No. 11/051,865, filed on Feb. 4, 2005, now Pat. No. 7,263,195, which is a continuation-in-part of application No. 11/034,144, filed on Jan. 12, 2005, now Pat. No. 7,194,103.

(60) Provisional application No. 60/639,407, filed on Dec. 22, 2004, provisional application No. 60/639,173, filed on Dec. 22, 2004, provisional application No. 60/668,374, filed on Apr. 5, 2005.

(51) Int. Cl.
*H04R 25/00* (2006.01)

(52) U.S. Cl. ..... 381/322; 381/328

(58) Field of Classification Search ..... 381/322, 381/328, 380; 181/128, 129, 135
See application file for complete search history.

(56) References Cited

U.S. PATENT DOCUMENTS 7,139,404 B2 * 11/2006 Feeley et al. ..... 381/322

OTHER PUBLICATIONS

Jerry Harvey, Real World Gear: In-Ear Monitors (Part 2), http://www.livesoundint.com/archives/2004/jan/real2/real2.php, Live Sound International, Jan. 2004, Publisher: Live Sound International, pp. 1-8.

(Continued)

*Primary Examiner*—Brian Ensey
(74) *Attorney, Agent, or Firm*—Patent Law Office of David G. Beck

(57) ABSTRACT

An audio monitor system that includes a pair of in-ear monitors, each of which includes a connector and a corresponding detachable cable, is provided. Each connector may include a two pin jack assembly and each detachable cable may include a corresponding two pin plug assembly. Preferably, each plug assembly of each detachable cable includes a hooded member. More preferably, a portion of the hooded member covers a portion of the corresponding connector, thus effectively sealing the plug/connector assembly from contamination. Even more preferably, interlocking members are included on each hooded member and each corresponding connector, the interlocking members preventing accidental decoupling of the cable from the connector. The plug and connector assemblies may include means for insuring that a desired pin polarity is maintained during cable coupling.

10 Claims, 2 Drawing Sheets

OTHER PUBLICATIONS

Westone Music Products, Elite Series, http://www.westone.com/music/elite/html, Feb. 13, 2006, pp. 1-3.

Westone Elite Series Information, http://www.westone.com/marketing/music_es.pdf, downloaded Feb. 13, 2006,copyrighted 2002, p. 1.

AKG K 181 DJ headphones, http://www.akg.com/products//powerslave,id,909,pid,909,mynodeid,214,_language,EN.html, Nov. 16, 2005, pp. 1-2.

Creative HN-700 headphones, http://www.creative.com/products/pfriendly.asp?product=11392, Nov. 16, 2005, pp. 1-2.

Technics RP-DH1200 headphones, http://www.headsetzone.com/rpdj1200.html, Nov. 16, 2005, pp. 1-2.

* cited by examiner

IN-EAR MONITORS WITH REMOVABLE CABLES

CROSS-REFERENCES TO RELATED APPLICATIONS

This application is a continuation-in-part of U.S. patent application Ser. No. 11/044,510, filed Jan. 27, 2005 now U.S. Pat. No. 7,194,102, which is a continuation-in-part of U.S. patent application Ser. No. 11/034,144, filed Jan. 12, 2005 now U.S. Pat. No. 7,194,103, which claims the benefit of U.S. Provisional Patent Application Ser. Nos. 60/639,407, filed Dec. 22, 2004, and 60/639,173, filed Dec. 22, 2004, the disclosures of which are incorporated herein by reference for any and all purposes.

This application is also a continuation-in-part of U.S. patent application Ser. No. 11/051,865, filed Feb. 4, 2005 now U.S. Pat. No. 7,263,195, which is a continuation-in-part of U.S. patent application Ser. No. 11/034,144, filed Jan. 12, 2005 now U.S. Pat. No. 7,194,103, which claims the benefit of U.S. Provisional Patent Application Ser. Nos. 60/639,407, filed Dec. 22, 2004, and 60/639,173, filed Dec. 22, 2004, the disclosures of which are incorporated herein by reference for any and all purposes.

This application also claims priority from U.S. Provisional Patent Application Ser. No. 60/668,374, filed Apr. 5, 2005, the disclosure of which is incorporated herein by reference for any and all purposes.

FIELD OF THE INVENTION

The present invention relates generally to audio monitors and, more particularly, to an in-ear monitor audio system.

BACKGROUND OF THE INVENTION

In-ear monitors, also referred to as canal phones, are commonly used to listen to both recorded and live music. A typical recorded music application would involve plugging the in-ear monitors into a music player such as a CD player, flash or hard drive based MP3 player, home stereo, or similar device using the monitors' headphone jack. Alternately, the monitors can be wirelessly coupled to the music player. In a typical live music application, an on-stage musician wears the monitors in order to hear his or her own music during a performance. In this case, the monitors are either plugged into a wireless belt pack receiver or directly connected to an audio distribution device such as a mixer or a headphone amplifier.

In-ear monitors are quite small and are normally worn just outside the ear canal. As a result, the acoustic design of the monitor must lend itself to a very compact design utilizing small components. Some monitors are custom fit (i.e., custom molded) while others use a generic "one-size-fits-all" earpiece.

Although both in-ear monitors and headphones offer the user the ability to hear a source in stereo, the source being either recorded or live audio material, in-ear monitors offer significant advantages. First, in-ear monitors are so small that they are practically invisible to people that are at any distance from the user, a distinct advantage to a musician who would like to discretely achieve the benefits of headphones on-stage (e.g., improved gain-before-feedback, minimization/elimination of room/stage acoustic effects, cleaner mix through the minimization of stage noise, etc.). Second, due to their size, in-ear monitors have little, if any, effect on the mobility of the user (e.g., musician, sports enthusiast, etc.). Third, in-ear monitors can more easily block out ambient sounds than a set of headphones, thus allowing them to operate at lower sound pressure levels than typical headphones in the same environment, thereby helping to protect the user's hearing.

Although a variety of in-ear monitors have been designed, a failure of any component within the audio monitor system (e.g., earpiece, cable, diaphragm, etc.) requires the replacement of the complete monitor set. As many in-ear monitor systems are quite expensive, both due to the manufacturing costs of the miniature diaphragms and armatures used therein and the use of custom molded earpieces, replacing a set of in-ear monitors can be prohibitively costly. Accordingly, what is needed in the art is an in-ear monitor system that provides the user with greater capabilities to either replace, or upgrade, specific system components. The present invention provides such an in-ear monitor system.

SUMMARY OF THE INVENTION

The present invention provides an audio monitor system that includes a pair of in-ear monitors, each of which includes a connector. Each in-ear monitor includes a detachable cable that can be coupled to the corresponding connector on the corresponding in-ear monitor. In at least one embodiment, each connector is comprised of a two pin jack assembly and each detachable cable includes a corresponding two pin plug assembly.

In another aspect of the invention, each plug assembly of each detachable cable includes a hooded member. Preferably, a portion of the hooded member covers a portion of the corresponding connector, thus effectively sealing the plug/connector assembly from contamination. More preferably, interlocking members are included on each hooded member and each corresponding connector, the interlocking members preventing accidental decoupling of the cable from the connector.

In another aspect of the invention, the plug and connector assemblies include means for insuring that a desired pin polarity is maintained during cable coupling.

A further understanding of the nature and advantages of the present invention may be realized by reference to the remaining portions of the specification and the drawings.

DESCRIPTION OF THE SPECIFIC EMBODIMENTS

Figure 1:
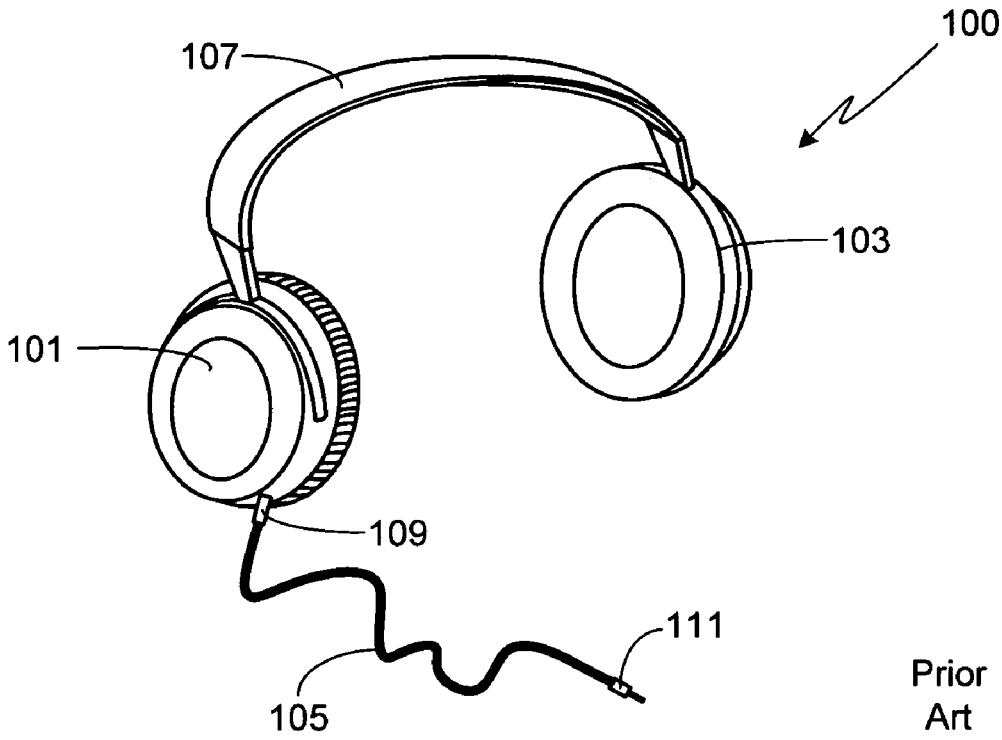
FIG. 1 is a perspective view of a headphone system according to the prior art.

FIG. 1 is a perspective view of a set of headphones 100 according to the prior art. In general, headphone set 100 includes left and right ear units 101/103, means for holding the ear units against the user's head, and a cable 105. Each ear unit contains a driver. Typically, each ear unit 101/103 will also include a headphone "can", the portion of the headphone that maintains the driver at an appropriate distance from the user's ear, minimizes ambient sounds, and provides a padded contact surface so that the headphones are relatively comfortable to wear. In the illustrated set of headphones, an adjustable headband 107 holds the ear units against the user's head.

In at least one configuration of a prior art headphone set, cable 105 is removable from the headphones via a single connector 109, thus allowing broken cables to be replaced without replacing the entire headphone set. This capability also allows the user to use a headphone cable that is properly sized for their particular application; for example short cables for listening to music while commuting and longer cables for use with a home theater system. Cable 105 also includes a standard headphone jack (e.g., ¼ inch phono plug) for coupling the headphones to the desired audio source.

Figure 2:
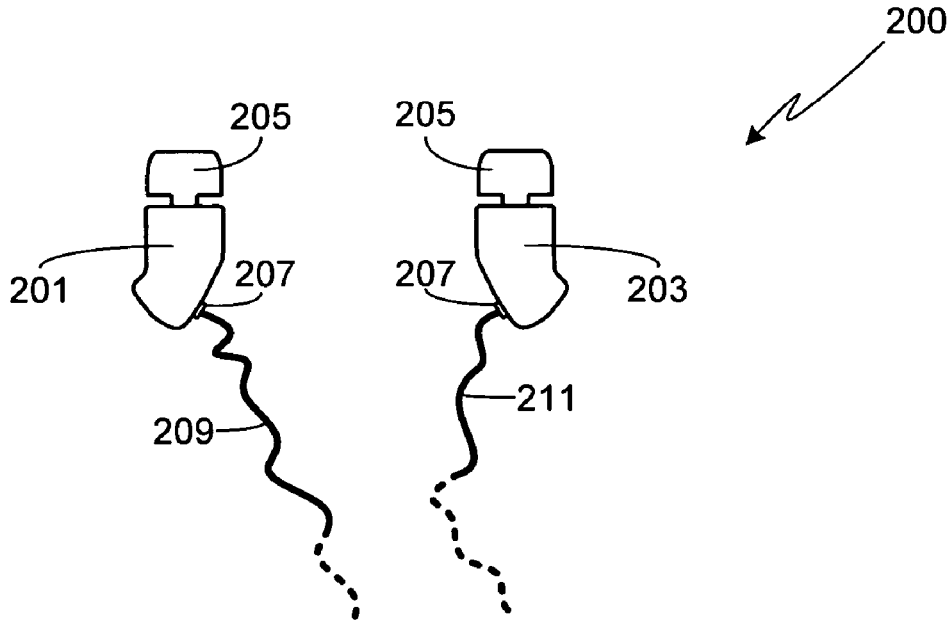
FIG. 2 is an illustration of an audio monitoring system in accordance with the invention.

FIG. 2 illustrates an embodiment of the invention. As shown, audio monitoring system 200 includes a left in-ear monitor 201 and a right in-ear monitor 203. In-ear monitors 201/203 can use either custom fit or one-size-fits-all style ear tips 205. It will be appreciated that the invention is not limited to a particular in-ear monitor style, nor is it limited to a particular driver configuration (e.g., single driver, combined driver/armature, etc.).

Each in-ear monitor includes a connection jack 207, which is preferably a female connection jack 207. Typically a 2-pin jack is used. In at least one embodiment of the invention, jack 207 is configured such that the mating plug can only fit in one direction, thus allowing a particular polarity to be maintained between the cable and the in-ear monitor to which the cable is attached. In general, each in-ear monitor 201/203 will be coupled to an individual cable 209/211, respectively, although it will be appreciated that the two cables may be joined into a single cable at some point along their length or at their respective distal ends. As there are numerous ways to terminate cables 209/211, some of which are described in further detail below, the end portions of cables 209/211 are not shown in FIG. 2, and are instead shown in phantom (i.e., as a dotted line).

Figure 3:
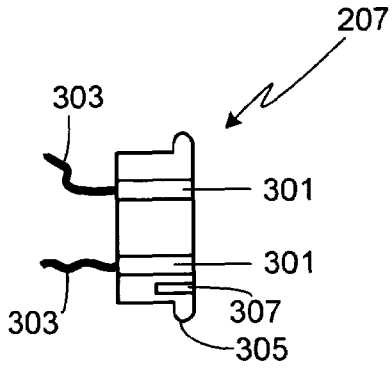
FIG. 3 is a cross-sectional view of a cable connector for use with the invention.
Figure 4:
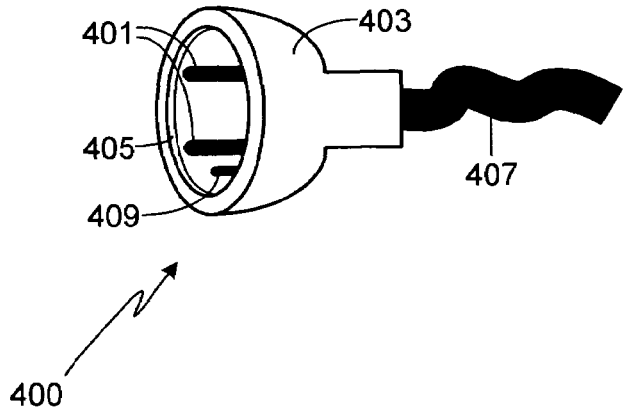
FIG. 4 is a perspective view of a cable plug assembly for use with the cable connector shown in FIG. 3.

FIG. 3 is a cross-sectional view of one embodiment of connector 207 while FIG. 4 is a perspective view of one embodiment of a corresponding plug assembly 400 for use with connector 207. Within connector 207 are two female jacks 301, shown with their corresponding wire interconnects 303, female jacks 301 designed to accept corresponding pins 401 contained within plug assembly 400. Preferably plug assembly 400 includes a hood member 403 which fits over lip 305 of connector 207. By including a corresponding interlocking member 405 on hood 403, plug assembly 400 and cable 407 are prevented from being accidentally disconnected from connector 207 and the in-ear monitor to which connector 207 is coupled. Interlocking members 305/405 and hood member 403 also help to prevent possible damage to the connections between the in-ear monitor and the corresponding cable, for example due to user perspiration. Although not required, preferably connector 207 and plug assembly 400 includes means for insuring which pin 401 is inserted into which jack 301 during assembly. In the illustrated embodiment, a third jack 307 and a corresponding pin 409 insure that plug assembly 400 is properly coupled to connector 207. It will be appreciated that there are countless techniques for performing this same function, including; (i) placing visual identifiers on the connector and the plug assembly, (ii) pin/jack placement within the respective assemblies; (iii) fabricating corresponding features (e.g., tab and notch) into the hood member and the connector lip, etc.

Figure 5:
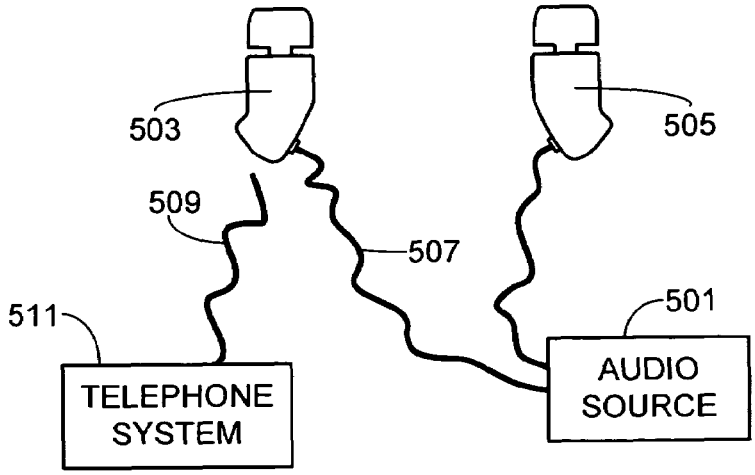
FIG. 5 is an exemplary application of the invention.

Unlike a conventional headset with a single cable connector as shown in FIG. 1, the present invention includes a detachable cable for each in-ear monitor (i.e., left and right in-ear monitors). The use of a pair of cable connections, one for each in-ear monitor, provides substantially greater flexibility than has been previously realized. For example, rather than simply allowing the user to replace damaged cables, or to replace the cables with cables of a different length, the present invention allows the user to configure the in-ear monitors in countless novel ways, depending upon a specific user need at a specific time. For example, and as illustrated in FIG. 5, part of the day the user may wish to listen to the same audio source 501 with both in-ear monitors 503/505 (e.g., left and right channels of a music source). Later in the day the user may wish to use a telephone. The user can accomplish this task, without having to buy additional in-ear monitors, by simply disconnecting one of the in-ear monitor cables (e.g., cable 507 from in-ear monitor 503) and replacing it with a cable (e.g., cable 509) connected to the secondary system (e.g., telephone system 511). Besides giving the user versatility, the present system also provides a convenient means of upgrading. For example, at some point in time the user may wish to replace cable 509 with a cable that includes an in-line microphone (not shown).

As previously noted, the use of individually replaceable in-ear monitor cables, in accordance with the invention, provides the end user with both application versatility and a convenient means of upgrading, all without requiring the replacement of the costly in-ear monitors. Other application examples include; (i) providing a musician the ability to feed one in-ear monitor with their own voice while feeding the second in-ear monitor, possibly at a different sound level, with the audio from the accompanying musicians; (ii) altering the performance of the individual in-ear monitors by including in-line filters in one or both monitor cables; (iii) using the same expensive in-ear monitors in diverse, unrelated systems; (iv) utilizing only one of the in-ear monitors for a specific application; (v) including in-line volume/mute controls in one or both channels, etc.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. An audio monitoring system comprising:

a first in-ear monitor, said first in-ear monitor comprising:
a first cable connector; and
a first generic one-size-fits-all ear tip;

a first detachable cable, wherein a first end of said first detachable cable is couple via a first cable detachable coupling to said first cable connector and wherein a second end of said first detachable cable is coupleable to an external audio source, said external audio source including music players;

a second in-ear monitor, said second in-ear monitor comprising:
a second cable connector; and
a second generic one-size-fits-all ear tip; and a second detachable cable, wherein a first end of said second detachable cable is coupled via a second cable detachable coupling to said second cable connector and wherein second end of said second detachable cable is coupleable to said external audio source.

2. The audio monitoring system of claim 1, wherein each of said first and second cable connectors further comprises a 2 pin female jack assembly.

3. The audio monitoring system of claim 2, wherein each of said first and second cable detachable couplings further comprises a 2 pin plug assembly.

4. The audio monitoring system of claim 1, wherein said first detachable cable further comprises a first hood member, wherein at least a portion of said first hood member covers a portion of said first connector when said first detachable cable is coupled to said first connector via said first cable detachable coupling.

5. The audio monitoring system of claim 4, wherein said second detachable cable further comprises a second hood member, wherein at least a portion of said second hood member covers a portion of said second connector when said second detachable cable is coupled to said second connector via said second cable detachable coupling.

6. The audio monitoring system of claim 1, wherein said first detachable cable further comprises a first hood member with a first interlocking member, wherein said first interlocking member is linked to a second interlocking member corresponding to said first connector when said first detachable cable is coupled to said first connector via said first cable detachable coupling.

7. The audio monitoring system of claim 6, wherein said second detachable cable further comprises a second hood member with a third interlocking member, wherein said third interlocking member is linked to a fourth interlocking member corresponding to said second connector when said second detachable cable is coupled to said second connector via said second cable detachable coupling.

8. The audio monitoring system of claim 1, wherein said first detachable cable is independent of said second detachable cable.

9. The audio monitoring system of claim 1, further comprising means for maintaining polarity between said first detachable cable and said first connector when said first detachable cable is coupled to said first connector via said first cable detachable coupling.

10. The audio monitoring system of claim 9, further comprising means for maintaining polarity between said second detachable cable and said second connector when said second detachable cable is coupled to said second connector via said second cable detachable coupling.

* * * * *